US007677173B2

(12) United States Patent
Fruh

(10) Patent No.: US 7,677,173 B2
(45) Date of Patent: Mar. 16, 2010

(54) BLANKET HOLDING RAIL

(75) Inventor: Frank Fruh, Neckartenzlingen (DE)

(73) Assignee: Fruh Schnellbautechnik GmbH, Neckartenzlingen (DE)

( * ) Notice: Subject to any disclaimer, the term of this patent is extended or adjusted under 35 U.S.C. 154(b) by 0 days.

(21) Appl. No.: 12/170,403

(22) Filed: Jul. 9, 2008

(65) Prior Publication Data

US 2009/0013887 A1 Jan. 15, 2009

(30) Foreign Application Priority Data

Jul. 9, 2007 (DE) ..... 20 2007 010 077 U

(51) Int. Cl.
*B41F 27/12* (2006.01)

(52) U.S. Cl. ..... 101/415.1; 101/378

(58) Field of Classification Search ..... 101/415.1, 101/378

See application file for complete search history.

(56) References Cited

U.S. PATENT DOCUMENTS 3,296,673 A 1/1967 Kirkpatrick
3,489,085 A * 1/1970 Kirkpatrick ..... 101/415.1
3,675,573 A * 7/1972 Hawks ..... 101/415.1
3,883,940 A 5/1975 Wagner
H440 H 3/1988 O'Rell

FOREIGN PATENT DOCUMENTS

DE 7820773 U1 10/1978
DE 3327972 A1 2/1985
FR 2279550 A1 7/1974
GB 2172949 A1 10/1986

* cited by examiner

*Primary Examiner*—Leslie J Evanisko
(74) *Attorney, Agent, or Firm*—Browdy and Neimark, PLLC

(57) ABSTRACT

In the case of a blanket holding rail for the releasable attachment of a blanket (12) on a printing mechanism roll comprising two holding limbs (13a and 13b) having an elongated configuration, and joined together by way of a back portion (14) and between which the blanket (12) may be clamped and be so fixed by means of additional securing means that the blanket (12) is secured to avoid its being pulled out athwart the longitudinal direction of the rail, the additional securing means are constituted by a claw means (16), which digs into the material of the blanket on clamping the blanket (12) in position.

7 Claims, 2 Drawing Sheets

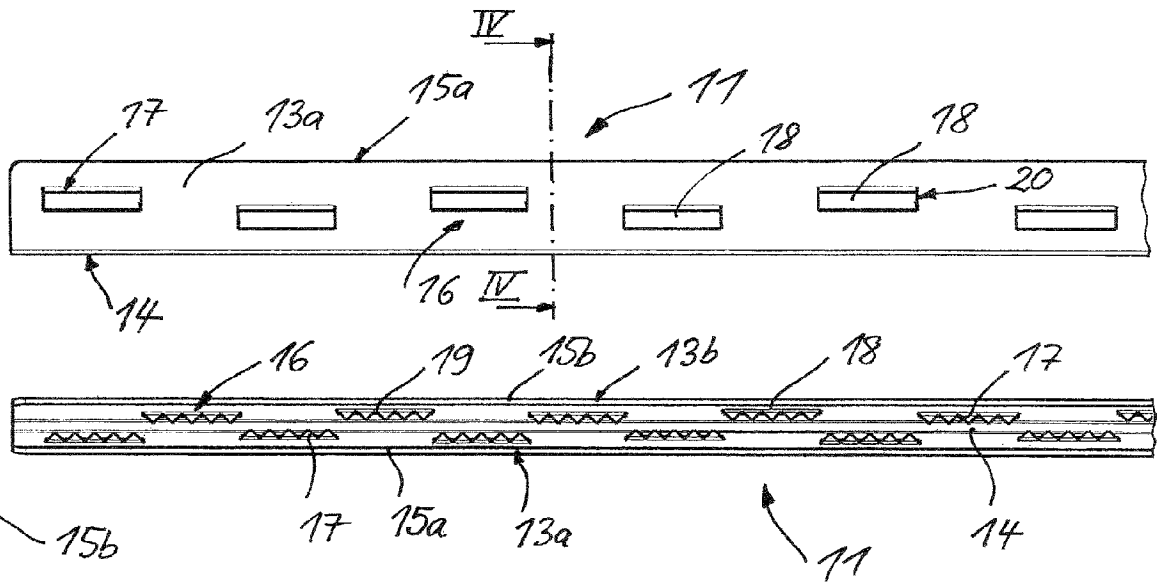
Fig. 2
Fig. 3
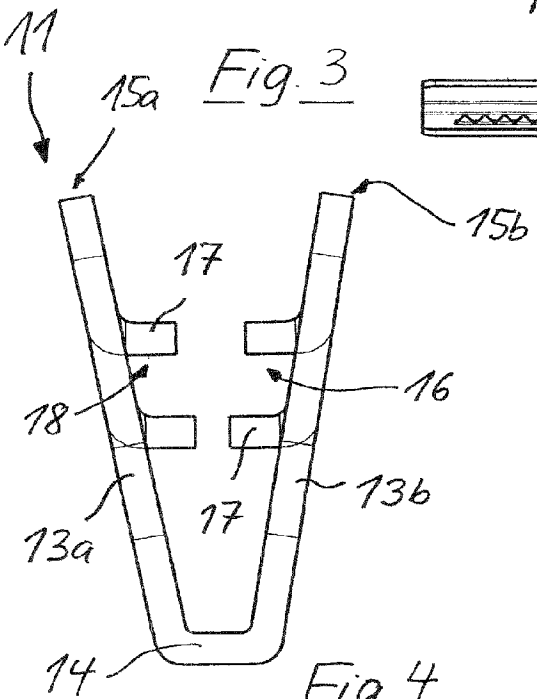
Fig. 4

BLANKET HOLDING RAIL

FIELD

The invention relates to a blanket holding rail for the releasable attachment of a blanket on a printing mechanism roll comprising two holding limbs having an elongated configuration, and joined together by way of a back portion and between which the blanket may be clamped and be so fixed by means of additional securing means that the blanket is secured to avoid its being pulled out athwart the longitudinal direction of the rail.

BACKGROUND

Such holding rails serve for holding a blanket, which for its part can be attached in a releasable fashion using generally two holding rails on a printing mechanism roll. During operation the blanket is subject to forces, which act athwart the longitudinal direction of the holding rail. Accordingly it is necessary for the blanket to be secured against being pulled out athwart the longitudinal direction of the rail, that is to say the holding rail is able to withstand transverse forces acting to pull it out. In the case of a conventional method of checking it is necessary for example the holding rail to resist transverse forces at a previously predetermined level. In order to comply with this additional securing means are necessary, namely bonding the blanket to the holding rail in addition in accordance with the prior art. Such bonding of the blanket and the holding rail is however complex and expensive and involves sources of error. As a rule the adhesives or glue are mixed on site. If the mixing ratio is incorrect the required adhesive strength is not achieved and the blanket is not properly held on the holding rail. Furthermore the application of the adhesive is an additional working step involving loss of time owing for the setting of the adhesive.

SUMMARY

One object of the invention is therefore to provide a blanket holding rail of the type initially mentioned which renders possible a quicker and cheaper connection between the blanket and the holding rail with at least the same quality of the connection as in the prior art.

This aim is to be achieved by a blanket holding rail for the releasable attachment of a blanket on a printing mechanism roll comprising: two holding limbs having an elongated configuration and being joined together by way of a back portion and between which the blanket is clamped and fixed by means of additional securing means constituted by a claw means which digs into the material of the blanket for clamping the blanket in a position that the blanket is secured to avoid being pulled out athwart a longitudinal direction of the rail, wherein the claw means comprises a plurality of claw teeth arranged in a plurality of teeth groups lying one behind the other in the longitudinal direction of the rail and having a spacing between them, wherein the spacing between the teeth groups is larger than a spacing between two adjacent claw teeth provided in the same teeth group, and wherein adjacent teeth groups of a respective holding limb are arranged with an offset in height in relation to one another, whereas every other teeth groups in the respective holding limb are at the same height. Further developments of the invention are defined in the dependent claims.

The blanket holding rail of the invention is characterized in that the additional securing means are constituted by a claw means, which hooks into the material of the blanket on clamping the blanket in position.

The securing action accordingly is owing to the clamping effect between the holding rail and the blanket and additionally owing to the hooking in of the claw means into the material of the blanket. Bonding of the blanket onto the blanket holding rail—the latter being named the holding rail for simplification—is unnecessary. Accordingly a slow working step involving substantial costs and is no longer necessary. The necessary holding of the holding rail is achieved owing to the hooking of the claw means in the material of the blanket.

In the case of a further development of the invention the claw means has several claw teeth arranged in the longitudinal direction of the rail.

In a more particularly preferred design the claw teeth are, in the mounted state of the blanket and slanted like barbed hooks toward the back portion of the holding rail. Preferably the claw teeth assume a position, irrespectively of the position of use of the holding rail, in which they are protruding from the inner wall of the respective holding limb, that is to say in such a manner that there is an obtuse angle between the claw teeth and the holding limb portion between the free holding limb end and the claw tooth base and an acute angle between the claw teeth and the holding limb portion between the claw tooth base. Such an alignment of the barbed claw teeth offers the further advantage that the blanket on being clamped is thrust still further into the holding rail, that is to say toward the back portion.

In the case of a further development of the invention both holding limbs bear claw teeth, a flat portion on each on the respectively other holding limb being opposite to the claw teeth. This flat portion can then function as a sort of counter-abutment, against which the blanket and the claw elements may abut so that the above mentioned deformation of the claws may take place toward the back portion.

It is more particularly preferred for the claw teeth to be arranged one behind the other and spaced apart in the longitudinal direction of the rail.

In a particularly preferred fashion the tooth groups of the one holding limb are arranged like a zipper with a offset in relation to the tooth groups on the other holding limb. Such an alternating succession renders possible a zipper-like fitting of the tooth group between each other, something which further increases the holding force plug holding rail.

It is possible for the teeth groups of a respective holding limb to be arranged with an offset in height in relation to each other. For instance it is possible for the respectively adjacent teeth groups to be offset in level in relation to one another, whereas in the row the next but one teeth groups are at the same level. Preferably the claw teeth have a triangular shape. However other geometries are possible too.

In a particularly preferred manner the claw teeth are formed integrally with the material of the holding limbs. Preferably the claw teeth are swaged from the material of the holding limb using a suitable swaging or embossing tool.

BRIEF DESCRIPTION OF THE DRAWINGS

A preferred embodiment of the invention is illustrated in the drawings and will be described in the following in detail.

FIG. 2 is a partial side view of the holding rail of FIG. 1.

FIG. 3 is partial bottom view of the holding rail of FIG. 1.

FIG. 4 shows a cross section on a larger scale of the holding rail of FIG. 2 along the line IV-IV of FIG. 2.

DETAILED DESCRIPTION OF EXAMPLE EMBODIMENTS

Figure 1:
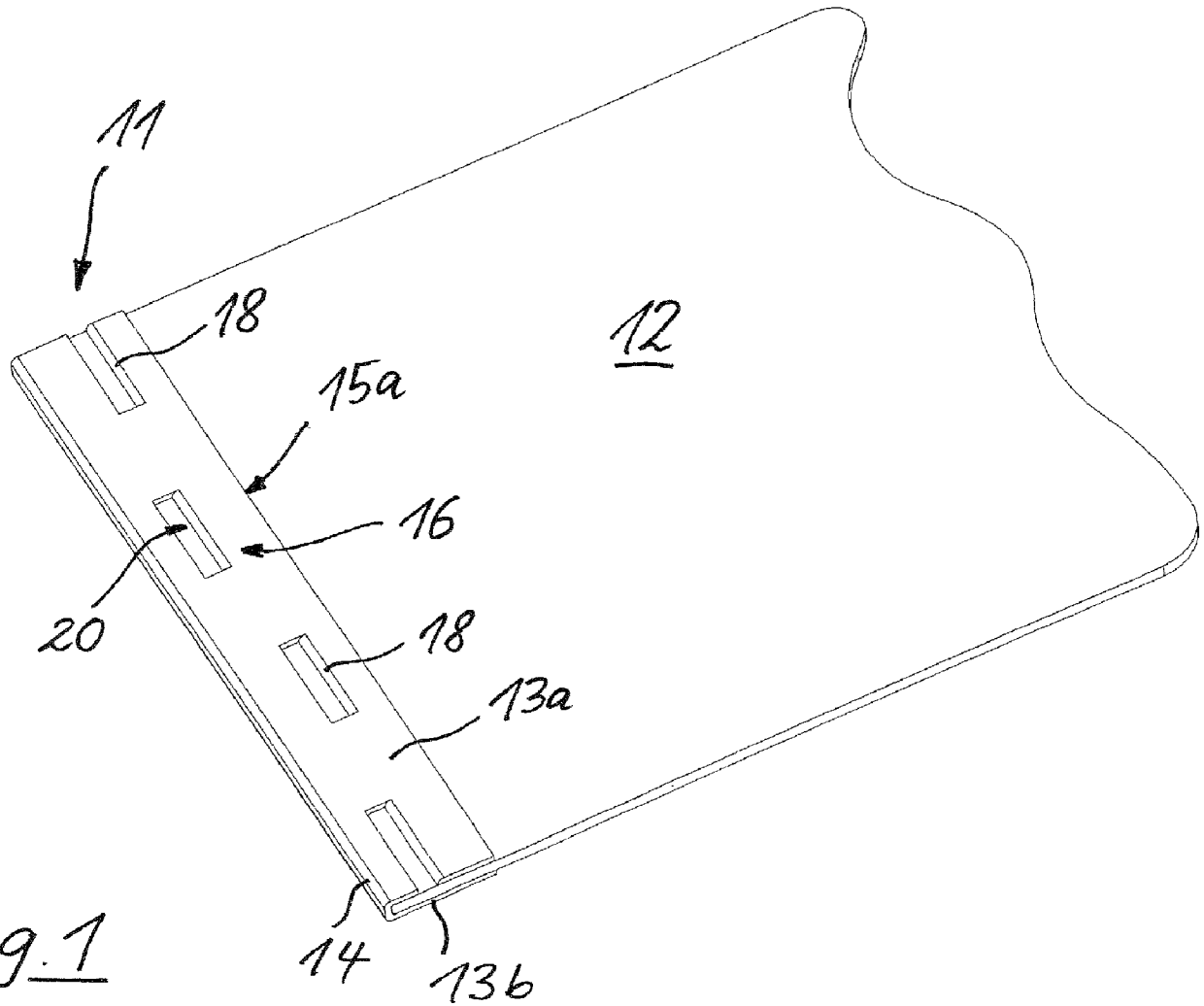
FIG. 1 is a perspective partial view of a preferred working example of the blanket holding rail with the blanket clamped in position.

The FIGS. 1 through 3 show a preferred working embodiment of the blanket holding rail 11 in accordance with the invention. The holding rail 11 serves the purpose of attaching a blanket 12 in a releasable fashion on a printing press roll, more particularly an ink transfer roll, which for its part transfers ink to the printing roll. For this purpose on two oppositely placed side edges of the blanket in each case such a holding rail 11 is attached. The holding rails 11 are then braced in a clamping device (not illustrated) on the respective printing roll, and over it the blanket 12 is then secured to the roll.

The holding rail 11 consists of steel material. It possesses two holding limbs 13*a* and 13*b* with a elongated configuration which are joined together by way of back portion 14. As more particularly illustrated in FIG. 4 the holding rail 11 is generally V-like in cross section when not in use, i.e. when no blanket 12 is secured in position.

The holding limbs 13*a* and 13*b* respectively possess free side edges 15*a* and 15*b* opposite to the back portion 14, the clearance between the two free side edges being greater, owing to the V-like shape, than the clearance distance between the holding limbs 13*a* and 13*b* in the vicinity of the back portion 14.

In order to secure the blanket 12 against being pulled out athwart the longitudinal direction of the rail additional securing means are necessary, which are constituted by a claw means 16, which on clamping the blanket 12 dig themselves into the material of the blanket 12.

The claw means 16 possesses several claw teeth 17 arranged in the longitudinal direction of the rail one after the other, which are formed to extend out of the material of the holding limbs 13*a* and 13*b* and are bent round inward so that they protrude from the inner wall of the respective holding limb 13*a* and 13*b*, that is to say toward the opposite holding limb 13*a* and 13*b*. The claw teeth 17 possess a sharp tooth point 19, which aids biting and hooking into the blanket material. The claw teeth 17 respectively possess a triangular configuration, preferably in the form of an isosceles and more particularly a right angled triangle.

The claw teeth 17 are arranged in several teeth groups 18 arranged spaced apart one behind the other in the longitudinal direction of the rail. In this respect the teeth groups 18 of the one holding limb 13*a* are arranged like a zipper with an offset in relation to the teeth groups 18 of the other holding rail 13*b*. The teeth groups 18 are respectively opposite to a flat portion of the holding limb 13*a* and 13*b*, which serves as a counter-abutment so that the claw teeth 17 together with the blanket 12 are thrust against a firm flat surface during clamping, something which increases the clamping effect. The zipper-like arrangement 18 therefore entails an increase in the holding force of the holding rail 11.

Furthermore the teeth groups of a respective holding limb 13*a* and 13*b* are arranged with an offset in height, and namely adjacent teeth groups 18 are offset in height in relation to one another, whereas the next but one teeth groups are at the same level. The teeth groups 18 lying in a row of one respective holding limb 13*a* and 13*b* are accordingly for their part not aligned but arranged like a letter S one behind the other.

For the production of the holding rail 11 firstly on a flat strip of sheet metal U-like cuts 20 are formed, for example by stamping, which later set the position of the teeth groups 18. The cuts 20 are therefore aligned on the respective holding limb 13*a* and 13*b* like a letter S one after the other and are additionally offset in relation to the cuts in the respectively other holding limb 13*a* and 13*b*. In this respect the cuts 20 are open toward the free side edges 15*a* and 15*b* of the respective holding limbs 13*a* and 13*b*. The next step is for the claw teeth 17 to be produced by embossing or swaging into the material lugs cut free by the cuts 20 and they are thrust inward. Finally the flat sheet metal strip is bent to form a holding rail 11, which is when not in use is V-like in cross section.

For attachment the blanket 12 is firstly introduced into the holding rail 11. The next step is for the two holding limbs 13*a* and 13*b* to be thrust together by a suitable swaging or embossing tool, the clearance width between the mutually opposite free side edges 15*a* and 15*b* of the holding limbs 13*a* and 13*b* being reduced. On thrusting the holding limbs 13*a* and 13*b* together the claw teeth will 17 dig into the material of the blanket 12. The claw teeth are bent toward the back portion 14 in the process, this meaning that the blanket 12 is thrust even further into the holding rail 11.

In the use condition of the holding rail 11 the claw teeth 17 are aligned with the claw teeth slanted at an obtuse angle to the limb portion between the side edges 15*a* and 15*b* and the claw tooth sets whereas between the claw teeth 17 and the portion between the back portion 14 and the set an acute angle is formed. The claw teeth 17 act like barbed hooks so that the blanket is secured against being pulled off athwart the longitudinal direction of the rail. The necessary holding force of the holding rail is produced.

Lastly it is possible to do without a costly and time consuming bonding operation between the blanket 12 and the holding rail 11.

The invention claimed is:

1. A blanket holding rail for the releasable attachment of a blanket (12) on a printing mechanism roll comprising:

two holding limbs (13*a* and 13*b*) having an elongated configuration and being joined together by way of a back portion (14) and between which the blanket (12) is clamped and fixed by means of additional securing means constituted by a claw means (16) which digs into the material of the blanket (12) for clamping the blanket (12) in a position that the blanket (12) is secured to avoid being pulled out athwart a longitudinal direction of the rail, wherein the claw means (16) comprises a plurality of claw teeth (17) arranged in a plurality of teeth groups (18) lying one behind the other in the longitudinal direction of the rail and having a spacing between them, wherein the spacing between the teeth groups (18) is larger than a spacing between two adjacent claw teeth (17) provided in the same teeth group (18), and wherein adjacent teeth groups (18) of a respective holding limb (13*a*, 13*b*) are arranged with an offset in height in relation to one another, whereas every other teeth groups (18) in the respective holding limb (13*a*, 13*b*) are at the same height.

2. The holding rail as set forth in claim 1, wherein in the clamped condition of the blanket (l2), the claw teeth (17) are slanted toward the back portion (14) of the holding rail (11).

3. The holding rail as set forth in claim 2, wherein each of the holding limbs (13*a* and 13*b*) have claw teeth (17), wherein a flat portion is formed on the other holding limb (13*a* or 13*b*) opposite to the claw teeth (17).

4. The holding rail as set forth in claim 1, wherein the teeth groups (18) of one holding limb (13*a*) are arranged with an offset in relation to the teeth groups (18) of the other holding limb (13*b*) so that when the holding limbs (13*b* and 13*b*) are closed, the teeth groups (18) of the one holding limb (13*a*) and the teeth groups (18) of the other holding limb (13*b*) alternatively clamp the blanket along the longitudinal direction of the rail.

5. The holding rail as set forth in claim 1, wherein the claw teeth (17) have a triangular configuration.

6. The holding rail as set forth in claim 1, wherein the claw teeth (17) are formed integrally from the material of the holding limbs (13*a* and 13*b*).

7. The holding rail as set forth in claim 1, wherein the claw teeth (17) are embossed from the material of the holding limbs (13*a* and 13*b*).

* * * * *